United States Patent [19]

Chang et al.

[11] Patent Number: 4,686,493

[45] Date of Patent: Aug. 11, 1987

[54] WIDEBAND SHORT SLOT HYBRID COUPLER

[75] Inventors: Donald C. D. Chang; Mon N. Wong, both of Torrance, Calif.

[73] Assignee: Hughes Aircraft Company, Los Angeles, Calif.

[21] Appl. No.: 844,651

[22] Filed: Mar. 27, 1986

Related U.S. Application Data

[63] Continuation-in-part of Ser. No. 782,677, Oct. 2, 1985.

[51] Int. Cl.[4] ..... H01P 5/18

[52] U.S. Cl. ..... 333/113; 333/122; 333/248

[58] Field of Search ..... 333/1, 24 R, 27, 100, 333/109, 113, 110, 122, 126, 135, 156, 157, 117, 208–212, 239, 248

[56] References Cited

U.S. PATENT DOCUMENTS 2,626,990 1/1953 Pierce ..... 333/126 X

*Primary Examiner*—Marvin L. Nussbaum

*Attorney, Agent, or Firm*—S. M. Mitchell; M. J. Meltzer; A. W. Karambelas

[57] ABSTRACT

A waveguide hybrid coupler is formed with a pair of waveguides of rectangular cross section and sharing a common sidewall. An aperture in the sidewall provides for the coupling of electromagnetic energy between a first of the waveguides and a second of the waveguides. An input terminal is located at an end of the first waveguide. A pair of stepped, multi-tiered abutments are disposed on the outer sidewalls of the waveguides opposite the coupling aperture. The dimensions of the abutment steps are selected to stagger-tune the frequency response of the coupler to achieve wideband operation.

11 Claims, 11 Drawing Figures

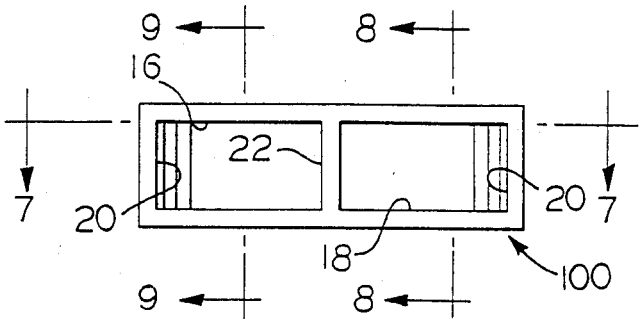
FIG. 6
FIG. 7
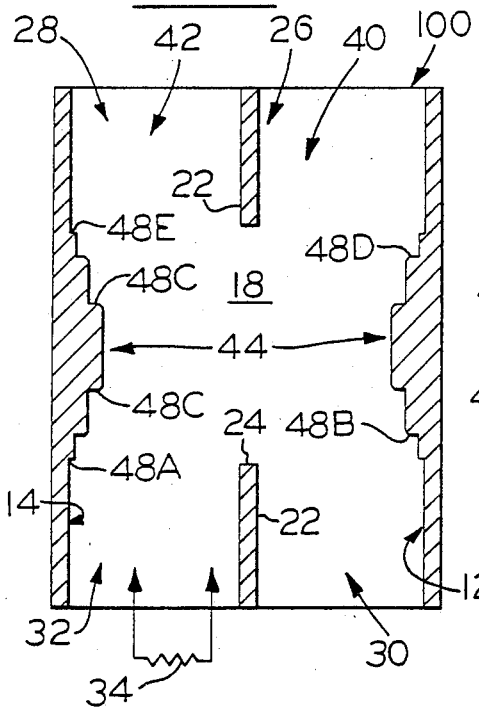
FIG. 8
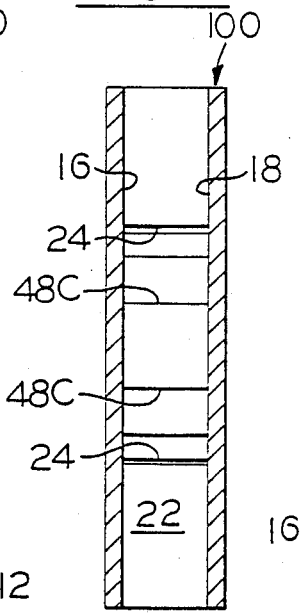
FIG. 9
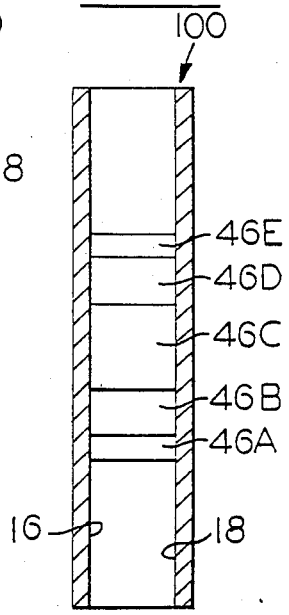

WIDEBAND SHORT SLOT HYBRID COUPLER

This application is a continuation-in-part application of application Ser. No. 782,677, filed on Oct. 2, 1985, entitled "Phase Compensated Hybrid Coupler," and assigned to the same assignee as this application.

BACKGROUND OF THE INVENTION

This invention relates to electrical coupler devices operable at microwave frequencies and more particularly to improved wideband short slot couplers.

Hybrid couplers are widely used in microwave circuits for coupling a portion of the electromagnetic energy in one waveguide to another waveguide. In some cases, the coupling ratio is one-half so as to produce an equal split of the power among the two waveguides. In other cases, a smaller amount of the power such as one-quarter or one-tenth of the power may be coupled from one waveguide to the second waveguide. In a common form of coupler, known as a hybrid coupler, the two waveguides are brought contiguous to each other and in parallel relationship so as to share a common wall. An aperture or slot in the common wall provides for the coupling of the electromagnetic energy.

While such couplers operate satisfactorily over relatively narrow frequency bandwidths, for example, in the range of 5–15% bandwidths for 3 dB couplers in the X-band range, performance over relatively wide bandwidths has been unsatisfactory.

It would therefore represent an advance in the art to provide a wideband, compact hybrid coupler operable at microwave frequencies.

SUMMARY OF THE INVENTION

A wideband short slot waveguide hybrid coupler is provided wherein two waveguides are positioned in side-by-side relation, each of the waveguides being formed of metallic walls arranged with a rectangular cross section having two long walls joined by two sidewalls. The two waveguides share a common sidewall. A coupling aperture is located within the common sidewall to provide the hybrid coupling. A phase shift of −90° is introduced inherently by the hybrid coupling of electromagnetic energy from the first waveguide to the second waveguide via the aperture in the common wall. An input terminal of the coupler is located in the first waveguide on one side of the coupling aperture. Two output terminals are provided for the hybrid coupler, these output terminals being a through port located in the first waveguide and a coupled port being located in the second waveguide on a side of the coupling aperture away from the input terminal.

In accordance with the invention, the width of the two waveguides is reduced at the coupling aperture by a pair of stepped abutments disposed against the opposing sidewalls of the waveguides. The stepped abutments comprise a multi-tier structure of risers and steps whose dimensions are selected to stagger-tune the frequency response of the coupler. One set of steps operates to peak the frequency response over one frequency sub-band, and other sets of steps peaks the frequency response over adjacent frequency sub-bands. The composite amplitude frequency response achieved by the stagger-tuning is relatively wideband.

BRIEF DESCRIPTION OF THE DRAWINGS

The foregoing aspects and other features of the invention are explained in the following description taken in connection with the accompanying drawings in which like reference characters identify corresponding parts throughout, and wherein:

FIG. 6 is an end view of the wideband, non-phasecompensated coupler of the invention.

FIG. 7 is a plan view of the coupler of FIG. 6 sectioned along the line 7—7 of FIG. 6.

FIG. 8 is a longitudinal sectional view of the coupler of FIG. 6 taken along line 8—8 of FIG. 6.

FIG. 9 is a longitudinal sectional view of the coupler of FIG. 6 taken along line 9—9 of FIG. 6.

DETAILED DESCRIPTION OF THE DISCLOSURE

Figure 1:
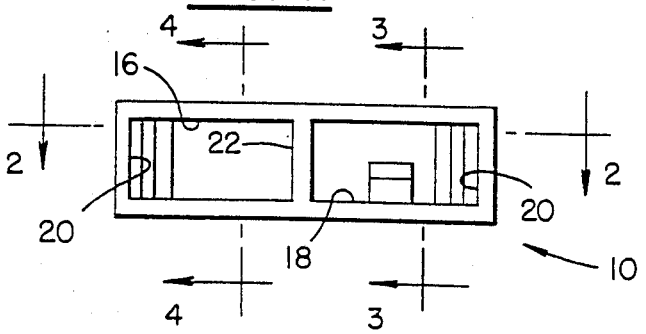
FIG. 1 is an end view of the compensated coupler of the invention.
Figure 2:
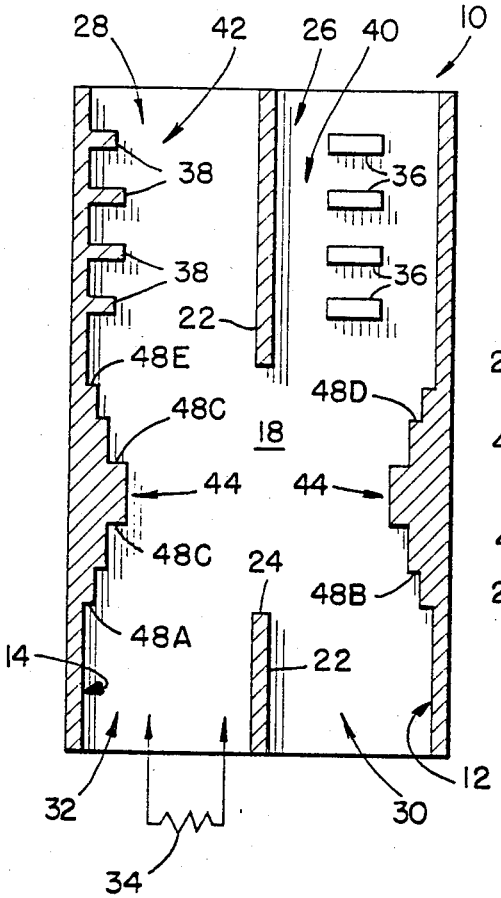
FIG. 2 is a plan view of the coupler sectioned along the line 2—2 of FIG. 1.
Figure 3:
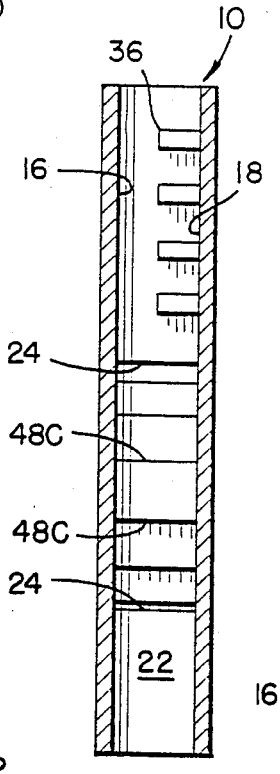
FIG. 3 is a longitudinal sectional view of the coupler taken along the line 3—3 in FIG. 1.
Figure 4:
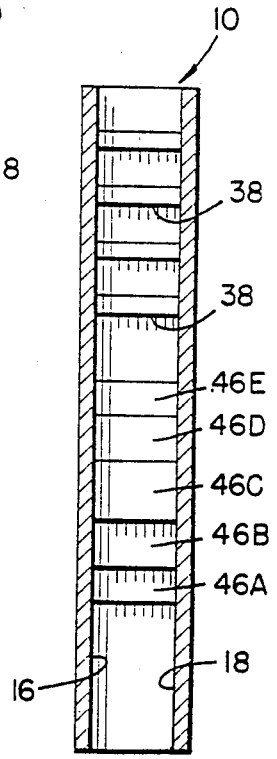
FIG. 4 is a longitudinal sectional view of the coupler taken along the line 4—4 of FIG. 1.

With reference to FIGS. 1–4, a hybrid coupler 10 is constructed in accordance with the invention for the coupling of electromagnetic energy. The coupler 10 is formed of a first waveguide 12 and a second waveguide 14, each of which have rectangular cross-sectional form wherein the ratio of a long wall to a short wall is 2:1. For operation at a microwave frequency of 12 GHz (gigahertz), waveguide type WR-75 is employed. Each of the waveguides have two long walls, namely a top wall 16 and a bottom wall 18, which are joined by short walls, namely outer sidewalls 20 and a common wall 22 which serves as an inner sidewall for each of the two waveguides 12 and 14. The coupler 10 is a very broad band device which, in the preferred embodiment of the invention, has an operating range extending from 11.7 GHz to 14.5 GHz.

In accordance with one aspect of the invention, the coupler 10 provides the dual functions of hybrid coupling plus phase compensation of electromagnetic energy between the two waveguides 12 and 14. The coupling of the electromagnetic energy is accomplished by a gate 24 located in the common wall 22. For 3 dB (decibels) coupling, the gate 24 is always opened and has a fixed length approximately equal to one free-space wavelength of the electromagnetic energy, as measured along a longitudinal axis of either waveguide 12 or 14. For lesser amounts of coupling, the length of the gate 24 is reduced, for example, to 0.8 wavelength for 6 dB coupling.

The coupler 10 has two output terminals, shown as a through port 26 and a coupled port 28, and located at ends of the waveguides 12 and 14, respectively. The coupler 10 further comprises an input port 30 located at an end of the first waveguide 12 opposite the through port 26 and an isolation port 32 located at an end of the second waveguide opposite the coupled port 28. The isolation port 32 is shown connected schematically to a resistor 34 which represents a nonreflecting load having an impedance matched to that of the second waveguide 14. Such a load (not shown) is constructed typically in the form of a well-known wedge which absorbs electromagnetic energy at the operating frequency of the coupler 10, and is conveniently mounted within a section of waveguide (not shown) connected to the isolation port 32 by flanges (not shown). In use, the coupler 10 could be connected to components of a microwave circuit (not shown); such components may include waveguide fittings which would be connected in a conventional manner, as by flanges (not shown) to the ports 26, 28, and 30 of the coupler 10.

The arrangement of the coupling gate 24 in the common sidewall 22 of the two waveguides 12 and 14 provides the configuration of a quadrature sidewall short slot hybrid coupler. Microwave signals coupled between the two waveguides via the gate 24 undergo a lagging 90° phase shift, this phase shift being inherent in the well-known operation of a quadrature sidewall short slot hybrid coupler. In many microwave circuits, such as those of a phased array antenna, such phase shift is unwanted, and some sort of phase compensation is required to equalize the phase between the microwave signals of the two waveguides 12 and 14.

The invention provides the requisite phase compensation by use of a set of four capacitive irises 36 located in the first waveguide 12 beyond the gate 24, and a set of four inductive irises 38 located in the second waveguide 14 beyond the gate 24. The configuration of the capacitive irises 36 in the waveguide 12 constitutes a phase shifter 40 which introduces a lagging phase shift of 45° at the through port 26. The configuration of the inductive irises 38 in the waveguide 14 constitutes a phase shifter 42 which introduces a leading phase shift of 45° at the coupled port 28. The combination of the −90° shift introduced at the gate 24 with the +45° shift introduced by the shifter 42 provides a net −45° at the coupled port 28 which balances the −45° shift introduced by the shifter 40 at the through port 26.

In order to use the coupler 10 in certain situations, such as a microwave circuit handling two-way communications via an antenna carried by satellite, it is desirable to construct the coupler 10 with a bandwidth wide enough to accommodate a transmit channel and a receive channel spaced apart in the frequency domain by an empty band which prevents cross talk between the two channels. The increased bandwidth of the coupler 10 is attained by use of stepped abutments 44 located at the outer sidewalls 20 on a center line of the gate 24. The abutments 44 reduce the width of the waveguides 12 and 14 at the gate 24 to enhance coupling of radiant energy via the gate 24.

Each of the abutments 44 is composed of three tiers having steps 46A–E and risers 48A–E. The dimensions of an abutment 44 may be adjusted to attain a desired bandwidth. Typical dimensions in terms of the free-space wavelength are as follows. The overall length is $1\frac{1}{4}$ wavelength, the step 46C is $\frac{1}{2}$ wavelength, the steps 46B and 46D are each $\frac{1}{4}$ wavelength, and the steps 46A and 46E are each $\frac{1}{8}$ wavelength. The risers 48A and 48E are each 0.050 inch, the risers 48B and 48D are each 0.045 inch, and the risers 48C on both sides of the step 46C are each 0.060 inch. It is noted that each of the risers is less than 1/10 of a wavelength so as to minimize reflections from the abutments 44.

With respect to the construction of the phase shifter 40, the two center irises 36 have an equal height of $\frac{1}{8}$ wavelength, this being 0.110 inch at the operating frequency of the coupler 10. The remaining two irises 36, at the ends of the set of irises, have an equal length of approximately 1/16 wavelength, the length measuring 0.080 inch at the operating frequency of the coupler 10, this being shorter than the height of the central irises 36. The thickness of each of the irises 36, as measured along the axis of the waveguide 12, is $\frac{1}{8}$ wavelength. The spacing on centers between successive ones of the irises 36 is $\frac{1}{4}$ of the guide wavelength. The width of each of the irises 36, as measured in a direction transverse to the waveguide axis, is approximately 0.2 inch. The length of the segment of the wall adjacent the capacitive irises 36 is 1.7 inch. The capacitive irises 36 are centrally spaced between the two sidewalls 20 and 22. While the capacitive irises 36 are shown as extending upwardly from the bottom wall 18, it is noted that, alternatively, they maybe constructed as extending downwardly from the top wall 16.

With respect to the construction of the phase shifter 42, the two center inductive irises 38 extend from the outer sidewall 20 a distance of 0.115 inch, and the remaining two irises 38 at the outer ends of the set of irises extend from the sidewall 20 a shorter distance, namely 0.110 inch. The spacing between centers of the inductive irises 38 is $\frac{1}{4}$ of the guide wavelength. The thicknesses of the inductive irises 38, as measured along an axis of the waveguide 14, is approximately $\frac{1}{8}$ free-space wavelength.

Other dimensions of the coupler 10 are as follows. The section of the common wall 22 adjacent the input port 30 measured 0.7 inch. The spacing between the sidewalls 20 and 22 in each of the waveguides 12 and 14 is 0.75 inch, this being approximately $\frac{3}{4}$ wavelength. The overall length of the coupler 10 is 3.6 inches.

In the construction of the coupler 10, brass or aluminum is employed in the fabrication of both the waveguide walls as well as the irises 36 and 38, and the abutments 44. Both of the metals provide adequate electrical conductivity, aluminum being employed when it is desired to reduce weight. Both the abutments 44 and the inductive irises 38 extend the full distance between the top wall 16 and the bottom wall 18. While capacitive irises can be constructed which extend the full distance between the short walls, the desired phase shift and bandwidth has been obtained in the preferred embodiment by constructing the capacitive irises 36 with a width, as noted above, which extends only part way the two sidewalls 22 and 20 of the first waveguide 12.

In operation, the coupler 10 operates as a Ku-band sidewall short slot hybrid coupler with phase compensation introduced into the output terminals 26 and 28. The phase compensation is non-dispersive in frequency, and the phase shift structures permit the construction of the coupling device in a compact light-weight assembly for use in broadband power division networks. The capacitive phase shifter 40 introduces a phase shift of −45° at the through port 26. The inductive phase shifter 42 introduces a +45° phase shift in the second waveguide 14, which phase shift is algebraically combined with the −90° phase shift introduced by the hybrid coupling. The algebraic combination of the −45° phase and the 90° phase shift in the second waveguide 14 produces a resultant phase shift of −45° at the coupled port 28, this resultant phase shift being equal to the −45° phase shift at the through port 26. Thus, upon the application of radiant energy to the input port 30, the resultant electromagnetic waves exiting the through port 26 and the coupled port 28 are in phase with each other.

Figure 5:
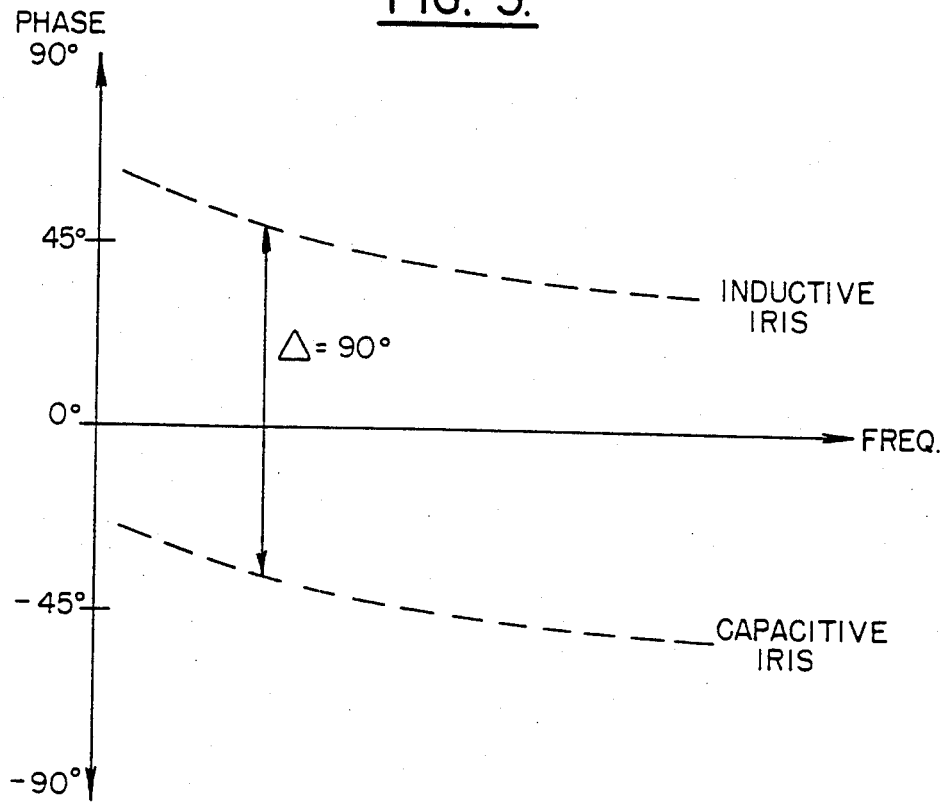
FIG. 5 is a graph of phase shift versus frequency of each of two phase shifting sections of the compensated coupler.

FIG. 5 shows a feature of the invention wherein the frequency dispersive characteristics of the phase shifters 40 and 42 track each other. As is well known, the phase shift introduced by a phase shifter at one frequency differs somewhat from the phase shift introduced at another frequency. The coupler 10 is to be employed over a wide range of frequencies and, accordingly, any frequency dependency of phase shift must also be corrected. While the nominal values of phase shift of the inductive iris 38 and the capacitive iris 36 are +45° and −45°, respectively, the actual values of phase shift vary from the nominal value as a function of frequency. As shown in FIG. 5, the inductive phase shifter 42 introduces a phase shift in excess of +45° at lower values of frequency, the value of phase shift dropping towards the nominal value for higher values of frequency. The phase shift introduced by the capacitive phase shifter 40 is smaller than the nominal value for lower values of frequency and increases to the nominal value at higher frequencies.

However, in accordance wtih an important feature of the invention, the difference between the phase shifts introduced by the series of inductive irises and the series of capacitive irises remains constant at 90° over the range of frequencies in the band of interest. Thus, the coupler 10 compensates for frequency induced variations in phase shift so as to provide for a broadband compensation of the inherent 90° phase shift associated with a hybrid coupler. As shown in FIG. 5, the upper trace for the series of inductive irises accurately tracks the lower trace representing the series of capacitive irises. Thereby, the phase compensation of the coupler 10 attains a major advantage over previously available phase compensatory devices in that the compensation of the invention is free of frequency dispersion. This advantage is attained in conjunction with the mechanical benefit of reduced package size and reduced weight.

To further illustrate another aspect of the invention, the hybrid coupler 100 of FIGS. 6–9 exhibits the increased bandwidth described above for the coupler 10 shown in FIGS. 1–4, but does not employ the phase shifters 40 and 42. The specific structure of the coupler 100 is identical to the coupler 10, except that no phase compensating elements 36 and 38 are employed, allowing the length of the waveguides to be reduced accordingly. Thus, for the disclosed embodiment, the two waveguides are WR-75 rectangular waveguides joined together by the common wall 22. The coupler is 1.75 inches wide and 2.25 inches long, and the width of the coupling gate 24 is adapted to provide an equal power split (3 dB coupling) of the incident energy between the through and coupled ports.

In operation, electromagnetic energy incident at the input port 30 of the hybrid coupler 100 will propagate at the $TE_{10}$ mode along the rectangular waveguide 12 toward the first region of reduced guide thickness between gate 24 and the riser 48A and step 46A of abutment 44. The maximum E-field location of the propagating energy is urged more closely toward the coupling gate 24 by the abutment 44, and transverse field current commences flowing through the coupling gate 24. As a result, electromagnetic energy of a $TE_{10}$ mode is excited along the auxiliary guide 14 and propagates toward the coupled port 28.

In a similar manner to that described with respect to riser 48A and step 46A, the successive sections of risers and steps 48B and 46B, 48C and 46C, 48D and 46D, and 48E and 46E will each contribute to coupling of the electromagnetic energy, although each section provides different amounts of coupling and at different frequencies. The total amount of coupling is mainly controlled by the length of the coupling gate 24 and the width of the respective abutment section comprising a riser and step, i.e., the width of each riser 48A–E. The length of each section, i.e., the length of each step 46A–E is an important factor in achieving a wideband frequency response. Thus, the coupler is staggered-tuned to achieve a wideband frequency response.

Figure 10:
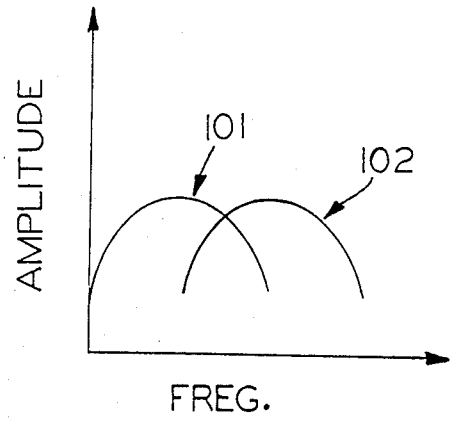
FIG. 10 is qualitative graph of the amplitude-frequency response of particular tuned sections of the coupler of FIG. 6.
Figure 11:
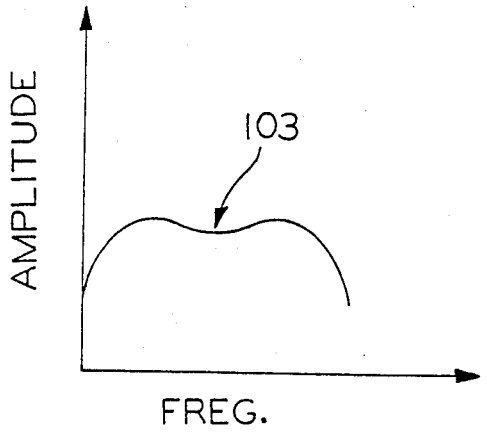
FIG. 11 is a qualitative graph of the composite amplitude frequency response of the coupler of FIG. 6.

To illustrate the staggered-tuned technique, FIGS. 10 and 11 are generalized, qualitative plots of the coupled port output signal amplitude as a function of frequency. In FIG. 10 reference arrow 101 indicates the amplitude response resulting from the step 46C and riser 48C. The response 101 peaks at a relatively lower frequency. Reference arrow 102 indicates the frequency response resulting from the respective riser and step sections 46A and 48A, 46B and 48B, 46D and 48D, and 46E and 48E. The response 102 peaks at a relatively higher frequency than that indicated by reference arrow 101. The composite response of all sections is indicated by the qualitative response curve 103 shown in FIG. 11. The composite response is relatively wider in bandwidth than the respective individual responses shown in FIG. 10.

Excepting the length of the waveguides 12 and 14, each of the elements comprising the coupler 100 have similar typical dimensions described above with respect to corresponding elements of coupler 10. Such an embodiment has been tested, and its performance is generally indicated by the data shown in Table I.

TABLE I

| FREQUENCY | AMPLITUDE DEVIATION | PHASE (COUPLED-THRU) | RETURN LOSS | ISOLATION |
|---|---|---|---|---|
| 11.7 to 12.2 GHz | ±.1 dB | −90° ± 1° | −22 dB | −22 dB |
| 14.0 to 14.5 GHz | ±.2 dB | −90° ± 1° | −20 dB | −20 dB |
| 11.6 to 14.6 GHz | ±.3 dB | −90° ± 1.5° | −19 dB | −18 dB |

The coupler 100 provides relatively non-frequency dispersive operation over the relatively wide frequency band of interest, 11.6 to 14.6 GHz.

It is to be understood that the above-described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A wideband waveguide hybrid coupler, comprising:

first and second waveguides having rectangular cross-sections and comprising respective longwalls and sidewalls, said waveguides being disposed in contiguous relationship and sharing a sidewall as a common dividing wall;

means for coupling electromagnetic energy within a wide frequency band between said first and second waveguides; and said coupling means comprising an aperture in said common wall and coupling enhancement sections engaging each of said waveguides via a sidewall in respective ones of said waveguides, said enhancement sections being tuned to provide frequency responses in particular frequency sub-bands within said wide frequency band to provide a stagger-tuned composite frequency response for said coupling means;

whereby said wideband coupler provides low attenuation to electromagetic signals having signal frequencies within said wide frequency band.

2. The coupler of claim 1 further comprising respective input and output terminals located at respective first and second ends of the first waveguide, and a coupled terminal disposed at a second end of said second waveguide, the first end of said second waveguide being terminated in a matched load.

3. The coupler of claim 2 wherein the size of said coupling aperture is adapted to couple about one-half of the electromagnetic energy incident at the input port into said second waveguide.

4. The coupler of claim 1 wherein said coupling means further comprises means for reducing the cross section of each of the first and second waveguides at said coupling means to enhance the coupling of electromagnetic energy between said first and second waveguides, said reducing means comprising respective sections whose diemnsions are selected to provide a stagger-tuned frequency response over the frequency band of interest.

5. The coupler of claim 4 wherein said reducing means comprises a pair of stepped abutments located at respective outer sidewalls of the first and second waveguides opposite said coupling aperture.

6. A wideband waveguide hybrid coupler, comprising:

a first waveguide and a second waveguide disposed in a contiguous side-by-side relationship and separated by a common dividing wall;

means for coupling electromagnetic energy between said first and second waveguides, said coupling means comprising a coupling aperture defined in said common dividing wall; and means for reducing the cross section of each of the first and second waveguides at said coupling means to enhance the coupling of electromagnetic energy between said first and second waveguides over a frequency band of interest, said reducing means comprising respective sections whose dimensions are selected to provide a stagger-tuned frequency response over the frequency band of interest.

7. The coupler of claim 6 wherein each of said waveguides comprises metallic walls assembled with a rectangular cross section comprising a pair of long walls and a pair of sidewalls, and wherein said common dividing wall comprises one of said sidewalls.

8. The coupler of claim 7 wherein said reducing means comprises a pair of stepped abutments located at the respective outer sidewalls of the first and second waveguides.

9. The coupler of claim 8 wherein said abutments are located opposite said coupling aperture, and comprise multiple tiers of steps separated by risers.

10. The coupler of claim 9 wherein said risers each extend less than 1/10 of a wavelength toward said common dividing wall so as to minimize electromagnetic reflections therefrom.

11. The coupler of claim 9 wherein each of said abutments comprises three tiers of steps disposed in planes substantially parallel to the common dividing wall, the first tier closest to said coupling aperture comprising a first step having a length of about $\frac{1}{2}$ wavelength, the second tier comprising second and third steps, one on either side of said first step and having a length of about $\frac{1}{4}$ wavelength, and the third tier comprising fourth and fifth steps disposed outwardly away from said first step outside said respective second and third steps, said fourth and fifth steps each having a length of about $\frac{1}{4}$ wavelength.

* * * * *